US005393058A

United States Patent [19]

Rowland et al.

[11] Patent Number: 5,393,058

[45] Date of Patent: Feb. 28, 1995

[54] ROBOT GOLF GAME

[76] Inventors: Bruce Rowland, 2316 Bruner Ave., Bronx, N.Y. 10469; Dean Rowland, 56 Temple St., Newburyport, Mass. 01950

[21] Appl. No.: 58,541

[22] Filed: May 5, 1993

[51] Int. Cl.[6] ..... A63F 7/06

[52] U.S. Cl. ..... 273/87.4; 273/87 R; 273/87.2; 446/352; 446/366

[58] Field of Search ..... 273/87.4, 87.2, 87 R, 273/176 R, 176 AB, 94 R, 85 G; 446/352, 355, 290, 366

[56] References Cited

U.S. PATENT DOCUMENTS

| | | | |
|---|---|---|---|
| 1,391,306 | 9/1921 | Eliaser . | |
| 1,552,536 | 9/1925 | Blevins et al. . | |
| 1,681,799 | 8/1928 | Clark . | |
| 1,825,778 | 10/1931 | Chester . | |
| 2,014,993 | 9/1935 | Stayton . | |
| 3,050,307 | 8/1962 | Glass . | |
| 3,054,615 | 9/1962 | Budish . | |
| 3,072,406 | 1/1963 | Yee . | |
| 3,179,413 | 4/1965 | Leclerc . | |
| 3,190,653 | 6/1965 | Karthaus . | |
| 3,199,249 | 8/1965 | Carver et al. | 446/290 |
| 3,458,195 | 7/1969 | Neubeck | 273/87.4 |
| 3,503,613 | 3/1970 | Caya et al. . | |
| 3,537,576 | 11/1970 | Macaluso | 273/87.2 |
| 3,617,064 | 11/1971 | Collup . | |
| 3,769,894 | 11/1973 | Conklin | 273/185 A |
| 3,809,404 | 5/1974 | Fikse | 273/87.4 |
| 3,874,112 | 4/1975 | Sapkus et al. . | |
| 3,928,932 | 12/1975 | Maurer . | |
| 4,058,313 | 11/1977 | Spradlin | 273/87.4 |
| 4,184,270 | 1/1980 | Presbrey | 434/252 X |
| 4,202,545 | 5/1980 | Watanabe . | |
| 4,239,217 | 12/1980 | Thieme et al. | 273/87.4 |
| 4,279,419 | 7/1981 | Barnes . | |
| 4,322,081 | 3/1982 | Terry et al. . | |
| 4,504,055 | 3/1985 | Wells | 273/87 R |
| 4,591,158 | 3/1986 | Samson et al. | 273/87.4 |
| 5,226,660 | 7/1993 | Curchod | 273/185 B |
| 5,249,967 | 10/1993 | O'Leary et al. | 434/247 |

*Primary Examiner*—Theatrice Brown
*Assistant Examiner*—Kerry Owens
*Attorney, Agent, or Firm*—Harold L. Burstyn; Thomas R. Morrison

[57] ABSTRACT

A simulated golf game in which a remotely controlled golfer plays on a miniature course, The physical mechanisms and methods of control of the game are directed to heighten its realism. The course has all the characteristics of a real golf course, e.g., hills, valleys, sand traps, and trees. The golfer is a model human figure who plays a miniature ball free that is to roll anywhere on the course. The golfer is remotely controlled through an overhead gantry positioning mechanism that connects to the golfer's back by way of a small-diameter rigid tube. The gantry simulates walking by moving the tube, with the golfer attached, about the golf course. Animation of the golfer itself (bending at the waist, swinging the club, etc.) is effected by a set of electric motors driving cables running inside the tube. Many of the motors are operated simultaneously to give the golfer a lifelike look. The motor operations are controlled by a computer. The game can be played by a person with a joystick control that requires skill to manipulate. Alternatively, the computer can play the game by itself by locating the ball's position with the aid of an overhead camera. The computer can also assist the human player to varying degrees to provide the game with beginner and advanced levels of skill.

20 Claims, 13 Drawing Sheets

ROBOT GOLF GAME

BACKGROUND OF THE INVENTION

This invention relates to a game played by a remotely controlled figure on a miniature playing field. The invention emulates the real game as played on a real playing field by human players.

Many people who play golf or other sports become handicapped from old age, disease, or accident so that they can no longer go out on a real playing field to play a real game. Yet their handicap need not and often does not diminish their interest in the game. They can derive the same pleasure by playing a model game as they did from the real game. (See, e.g., U.S. Pat. No. 4,322,081, col. 1, lines 11–18). This pleasure is heightened in proportion as the model game replicates the real game.

No prior-art replication of the game of golf on a model offers an alternative that is the least bit realistic. The model golfer in previous golf games may be mounted on a cart (e.g., U.S. Pat. No. 4,591,158) or directed by an apparatus larger than the golfer itself (e.g., U.S. Pat. No. 4,239,217). The model golf courses offer little relief, unlike real golf courses, because the model golfers that play on them might have difficulty following a steeply sloping terrain (e.g., U.S. Pat. No. 4,058,313). Indeed, such a game may offer only a planar course with no attempt at realism (e.g., U.S. Pat. No. 4,202,545).

OBJECTS AND SUMMARY OF THE INVENTION

An object of the present invention is to provide a system that enables a person to play a field game with a model player and a ball or other game piece that offer a realistic simulation of the actual game.

A further object of the present invention is to provide a model golf game whose player automatically follows a model terrain, no matter how steeply sloping.

Still a further object of the present invention is to provide a system that enables a computer to play a model golf game without human intervention.

Yet a further object of the present invention is to provide a system that allows a computer to assist a human player who may be handicapped to play a model field game.

Still another object of the present invention is to demonstrate a generalized configuration to control one or several miniature human or animal figures or vehicles moving on a three-dimensional surface.

Briefly stated, the present invention provides a simulated golf game in which a remotely controlled golfer plays on a miniature course. The physical mechanisms and methods of control of the game are directed to heighten its realism. The course has all the characteristics of a real golf course, e.g., hills, valleys, sand traps, and trees. The golfer is a model human figure who plays a miniature ball free to roll anywhere on the course. The golfer is remotely controlled through an overhead gantry positioning mechanism that connects to the golfer's back by way of a small-diameter rigid tube. The gantry simulates walking by moving the tube, with the golfer attached, about the golf course. Animation of the golfer itself (bending at the waist, swinging the club, etc.) is effected by a set of electric motors driving cables running inside the tube. Many of the motors are operated simultaneously to give the golfer a lifelike look. The motor operations are controlled by a computer.

The game can be played by a person with a joystick control that requires skill to manipulate. Alternatively, the computer can play the game by itself by locating the ball's position with the aid of an overhead camera. The computer can also assist the human player to varying degrees to provide the game with beginner and advanced levels of skill.

According to an embodiment of the invention, a model game comprises: a model playing area; at least one model figure representing at least one person; means for supporting the at least one figure; the means for supporting including means for controlling a plurality of motions of the at least one figure; the means for controlling including means for modeling a plurality of motions of a real player playing a real game on a real playing area; and the means for modeling includes means for positioning the at least one figure on the model playing area.

According to a feature of the invention, apparatus for controlling a plurality of motions of a model figure representing a person comprises: the plurality of motions including a first class of motions of the figure as an entirety and a second class of motions of portions of the figure; first means for controlling, the first means controlling motions of the first class on a two-dimensional plane; second means for controlling, the second means controlling motions of the first class in a vertical dimension; third means for controlling, the third means controlling motions of the first class in rotation about an axis through the figure; fourth means for controlling, the fourth means controlling motions of the second class; means for supporting the figure; and the means for supporting further comprising support for the first, second, third, and fourth means for controlling.

According to another feature of the invention, apparatus for automatically determining a stroke by a model figure that directs a ball to a cup comprises: means for locating the ball on a playing surface; means for positioning the model figure adjacent the ball; means for determining, cooperating with the means for locating and the means for positioning, for calculating a force and a direction of the stroke; and means for making the stroke of the force in the direction, whereby the model figure causes the ball to move proximately to the cup.

According to still another feature of the invention, a method of automatically making a stroke by a model figure that directs a ball to a cup comprises: measuring a location of the ball on a playing surface in x, y, and z coordinates; positioning the model figure in locational x, y, z coordinates; positioning the model figure in an angular coordinate that measures rotation of the figure from an axis; determining a magnitude for the stroke; and operating the model figure to make the stroke.

According to yet another feature of the invention, apparatus for positioning a model figure comprises: means for measuring a location of the model figure on a surface in x and y coordinates; means for associating a z coordinate with each location of the model figure defined by the x and y coordinates; and means for positioning the model figure in the z direction according to the x and y coordinates when the location is occupied by the model figure.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
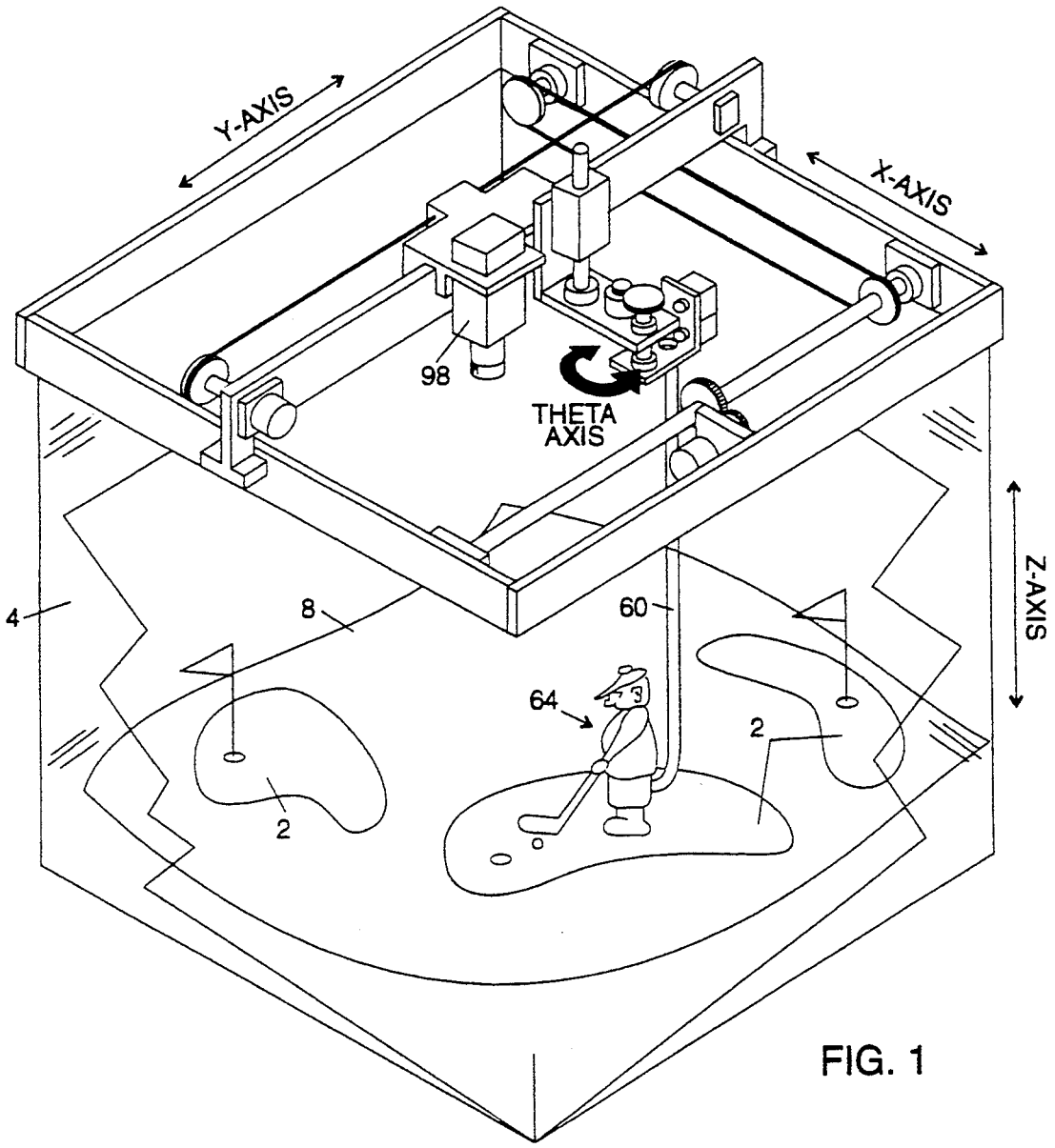
FIG. 1 is an isometric view of the overall apparatus.
Figure 1A:
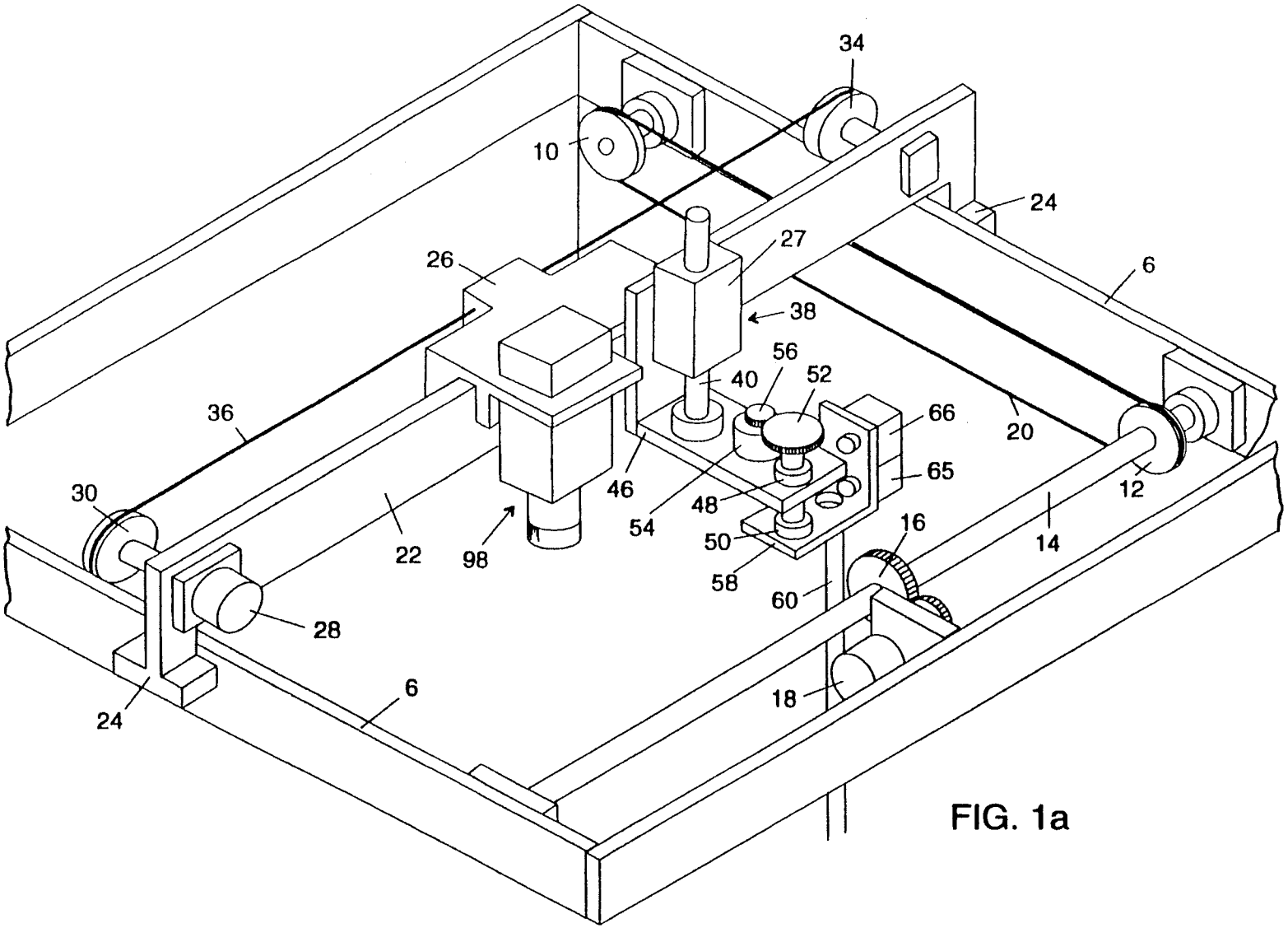
FIG. 1(A) is an enlargement of FIG. 1 showing the mechanisms that drive the golfer.

Referring to FIGS. 1 and 1(A), a golf course 8 in the present embodiment is in the shape of a square approximately 36" on each side. Course 8 contains three greens 2 with a golf hole in each. Greens 2 are flat and level; they are covered by green colored felt. The remainder of course 8 is sculpted from steel screen covered by latex compound. The sculpting comprises hills, valleys, and sand traps. The sand traps are covered with a mixture of real sand and clear glue. All other hill and valley areas are painted green. The maximum change in vertical elevation is about 3". Near the perimeters, all surfaces slope upwards to prevent a golf ball from coming to rest at an extreme edge.

Course 8 is surrounded on all four sides by clear plastic panels 4 about 18" high. Panels 4 keep the ball from being hit out of course 8 and prevent persons from damaging the mechanisms or being injured by their movements.

A pair of parallel rails 6 are fixed about 18" above the highest point of course 8. One rail 6 coincides with one border of course 8. The other rail 6 is mounted above the opposite border. Each rail 6 has an idler pulley 10 at one end. Each end of rail 6 opposite idler pulley 10 has a timing belt pulley 12, with both pulleys 12 sharing a common axle 14 whose length is about 36". The center of axle 14 has a gear 16 rigidly fixed to it. Gear 16 is driven by a stepping motor 18. Two timing belts 20, one on each rail 6, move in unison when axle 14 is driven by motor 18. A single rail 22 bridges the two rails 6. Rail 22 is attached at each end to a rolling carriage 24. Each carriage 24 is fastened to timing belt 20 on its corresponding rail 6 and is free to roll therealong.

The gear ratio, timing belt pulley diameter, and timing belt pitch are chosen so that one step of motor 18 drives the belts a distance of 1/1000" in the direction along the x-axis, as shown in FIGS. 1 and 1(A).

A rolling carriage 26 is set upon bridge rail 22. On one end of bridge rail 22 is a stepping motor 28 that drives a timing belt pulley 30 through a set of gears (not shown). The other end of bridge rail 22 has an idler pulley 34. A timing belt 36 runs between pulleys 30 and 34 and is driven by motor 28. Rolling carriage 26 is fastened to timing belt 36.

Rolling carriage 26 moves along bridge rail 22, driven by timing belt 36 at the rate of 1/1000" for each step of motor 28, providing motion in the direction along the y-axis.

Figure 11:
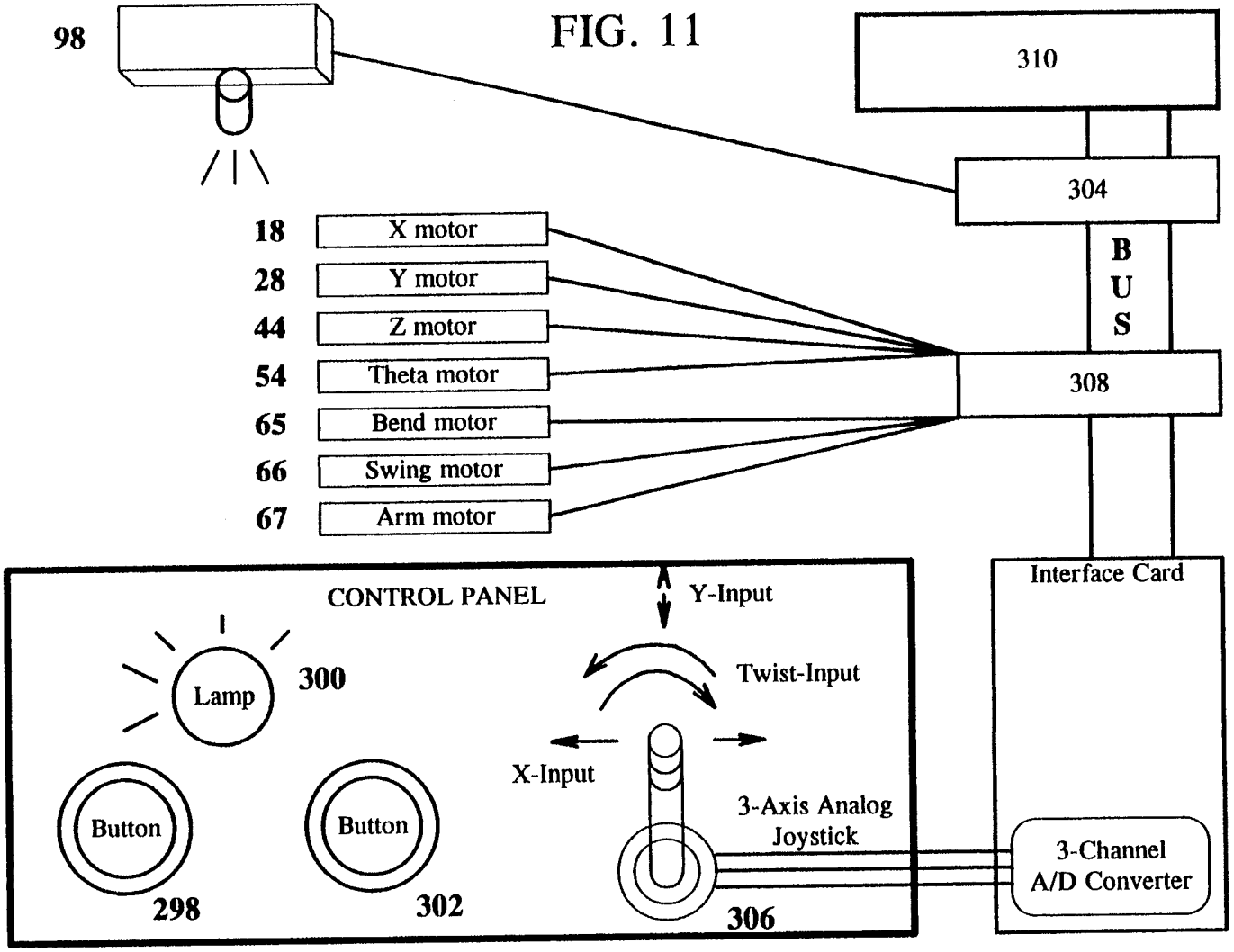
FIG. 11 is a functional block diagram of the electrical and electronic elements in the invention.

A black-and-white video camera 98 is fixed to carriage 26 facing downwards. As shown in FIGS. 1 and 1(A), camera 98 is positioned in the x-y plane, as is golfer 64, with camera 98 having a view of both golfer 64 and the area of course 8 immediately surrounding him. As shown in FIG. 11, a video frame grabber 304 enables a computer 310 to digitize the image as 240×256 gray-scale pixels. Camera 98's distance to the surface is nearly constant, as any variation results from changes in terrain elevation. Therefore the video image always represents an area of the surface of a fixed size. In the present embodiment, this area is about 17×22 inches, or about $\frac{1}{4}$ of the area of course 8. The computer can thus locate the ball's position on the surface by relating its video pixel position as a fixed offset from the present camera position in x-y coordinates.

A linear ball-slide assembly 38 is also mounted to carriage 26 so that a ball housing 27 is fixed to the carriage and a tube slider 40 moves in a vertical direction. Tube slider 40 is attached to a lead screw assembly driven by a stepping motor (not shown). Tube slider 40 has about 4" of vertical travel, the minimum requirement being the maximum vertical variation in the golf course surface. A small horizontal plate 46 is fastened to the bottom end of tube slider 40. A bearing 48 is set into plate 46 and holds a hollow tubular axle 50. The upper end of hollow tubular axle 50 has a gear 52 fastened coaxially. A stepping motor 54 with a gear 56 is mounted to plate 46.

Referring to FIGS. 1, 1(A), 4, and 5, a horizontal lower plate 58 is fastened at the bottom end of hollow tubular axle 50 and rotates therewith. To lower plate 58 is fastened a rigid, hollow support tube 60 that holds and locates a golfer 64. Support tube 60 has its upper end inserted into a hole 42 that passes through lower plate 58. Hole 42 is offset in lower plate 58 about 2" from the Theta axis, an axis of rotation 62, at the centerline of tube 50. Support tube 60 then projects vertically downwards about 16", a few inches above the highest elevation of the golf course. At the lower end, support tube 60 is bent at a 90-degree angle to become horizontal. The horizontal run extends towards the center of axis of rotation 62. Golfer 64 is about 4.5 inches tall and attached to the lower end of support tube 60. The vertical center of the golfer's waist is adjusted to coincide with axis of rotation 62.

Figure 2:
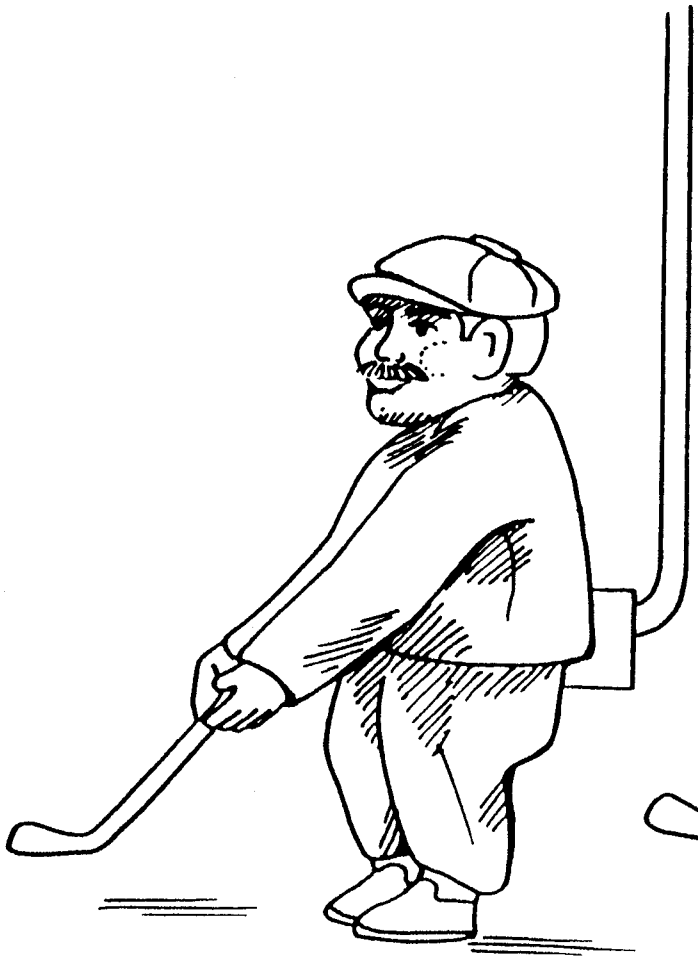
FIG. 2 is an isometric view of the golfer standing erect as during walking.
Figure 4:
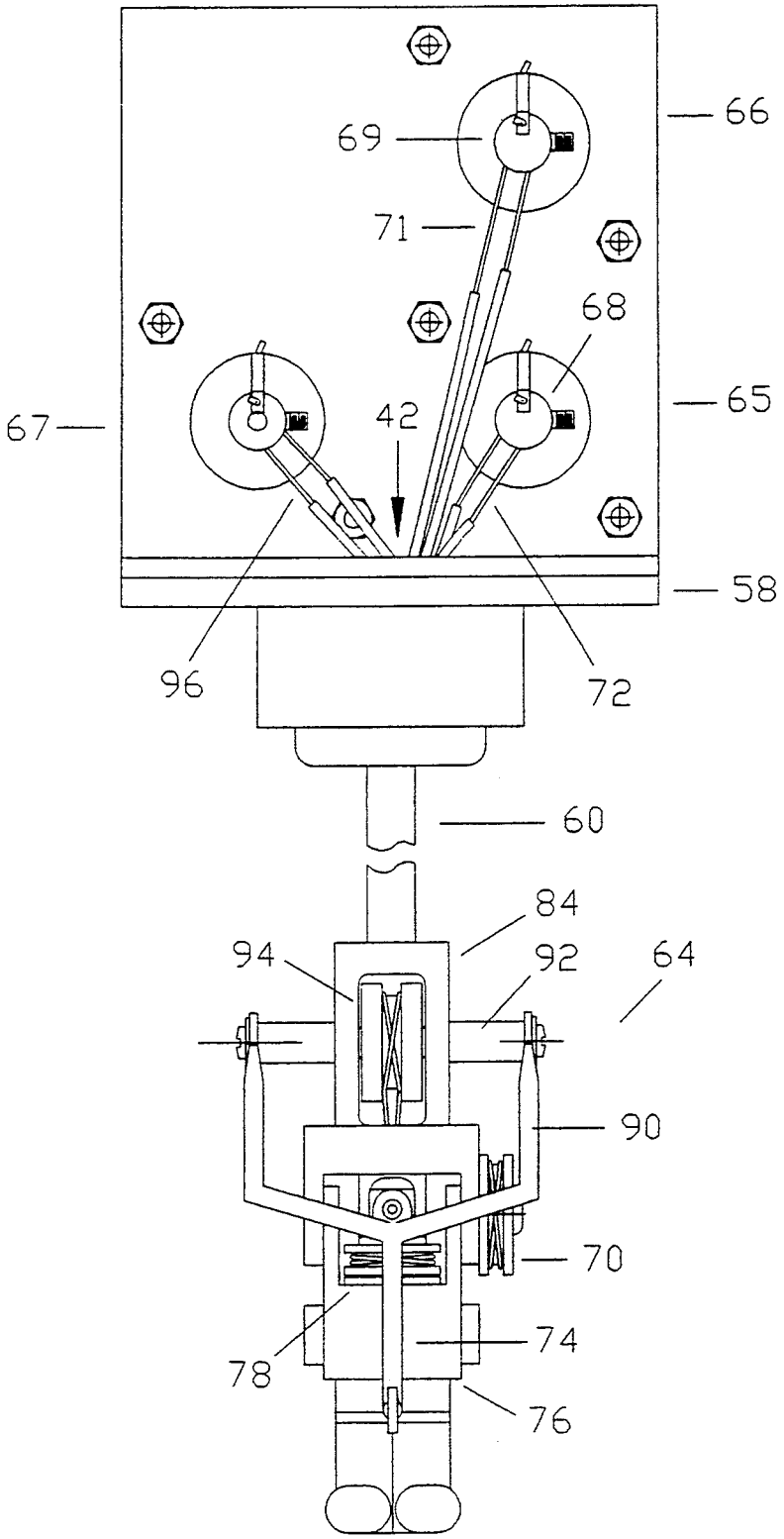
FIG. 4 is a front view of the golfer's internal mechanism and the motor assembly that moves the golfer locally showing their relationship.

Referring to FIG. 2, golfer 64 has a plastic head and is dressed with a cloth shirt and cloth knickers. Golfer 64's legs and shoes are plastic; they are attached to a base block 76 as shown in FIG. 4. Golfer 64 is shown in the rest position used during walking. In this position golfer 64 neither bends nor twists at the waist, and golfer 64's arms 90 and a club 74 that he holds are angled downwards to form a 45-degree angle with the centerline of a torso 84.

Figure 3:
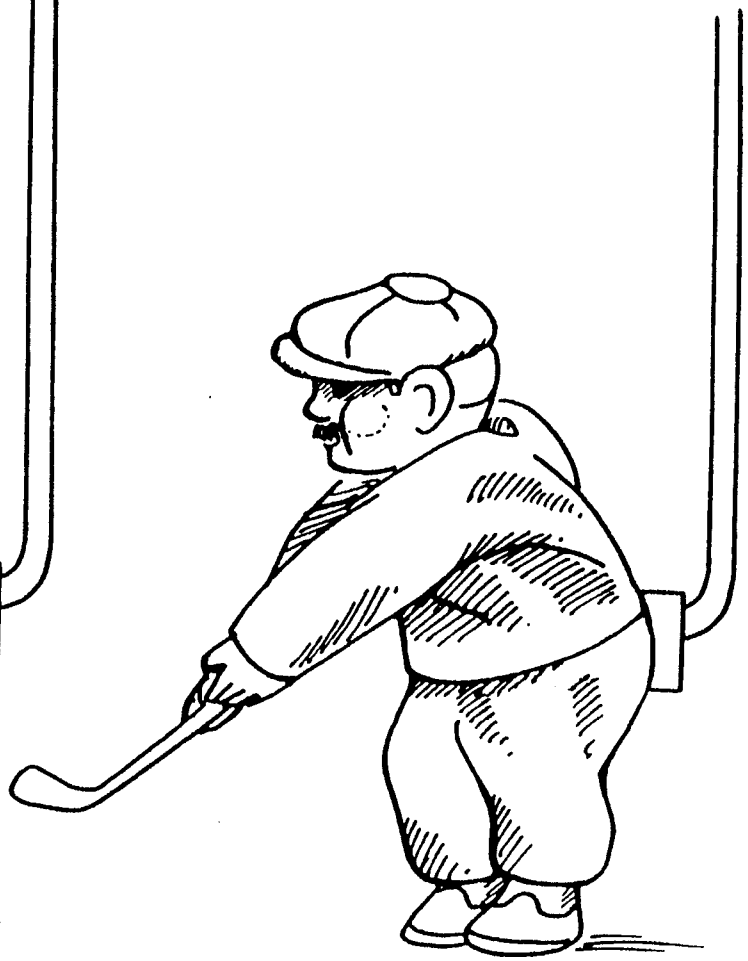
FIG. 3 is another isometric view of the golfer performing a golf swing.

Referring to FIG. 3, in mid-swing all three degrees of movement of which golfer 64 is capable are exercised. The waist is bent forward about 30 degrees and twisted whatever amount is required for the swing. Arms 90 and club 74 are raised to form an angle with torso 84 of approximately 90 degrees.

Figure 5:
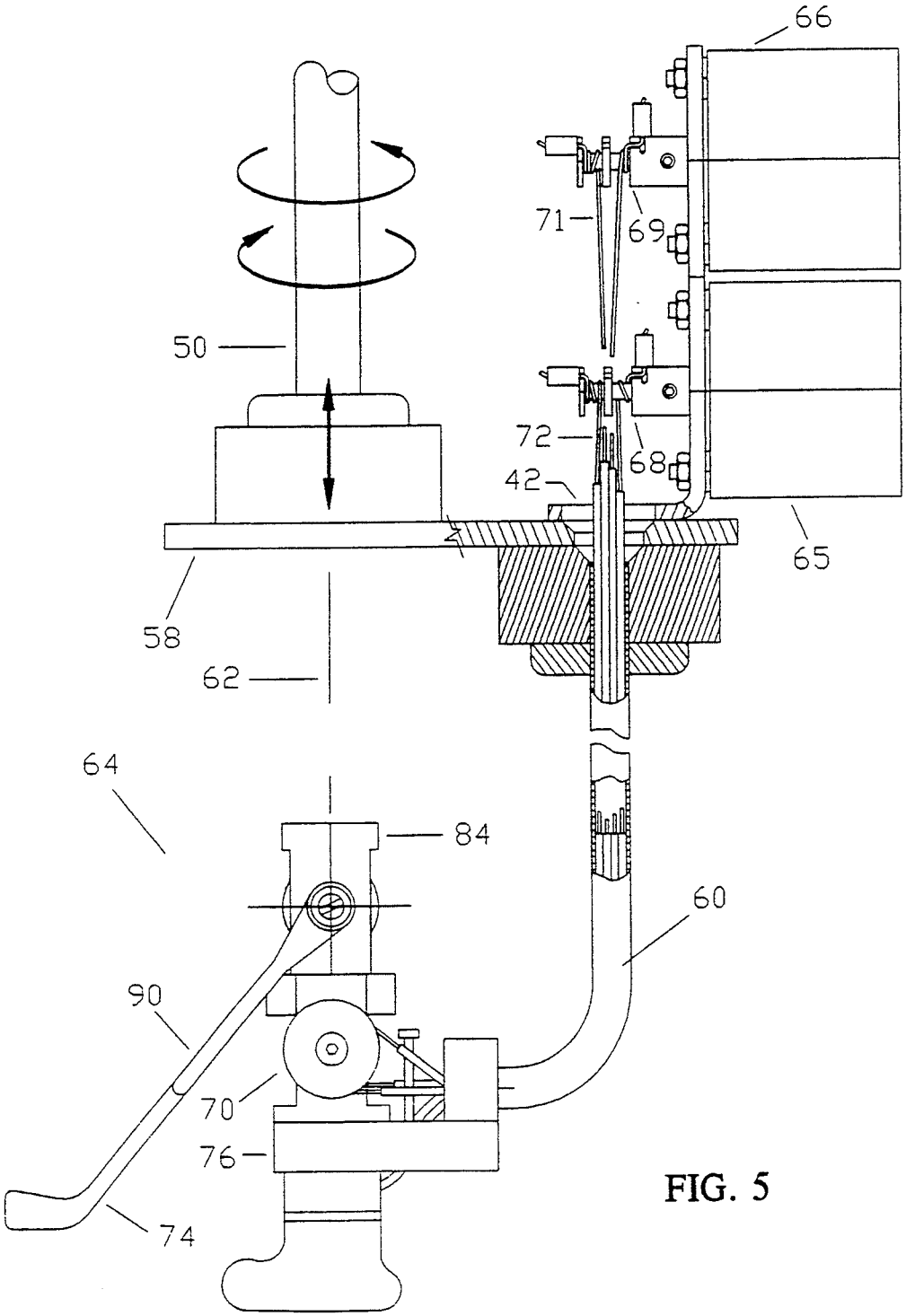
FIG. 5 is a side view of the golfer's internal mechanism and the motor assembly that moves the golfer locally as shown in FIG. 4.
Figure 7:
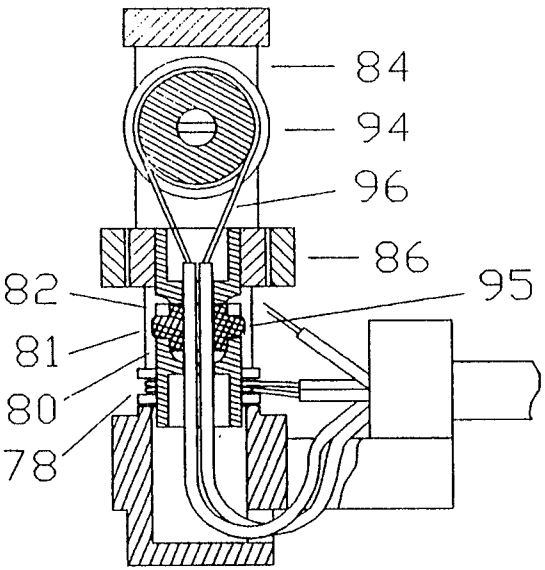
FIG. 7 is an enlarged cross-sectional view of the mechanism shown in FIG. 6 taken at section 6—6.
Figure 6:
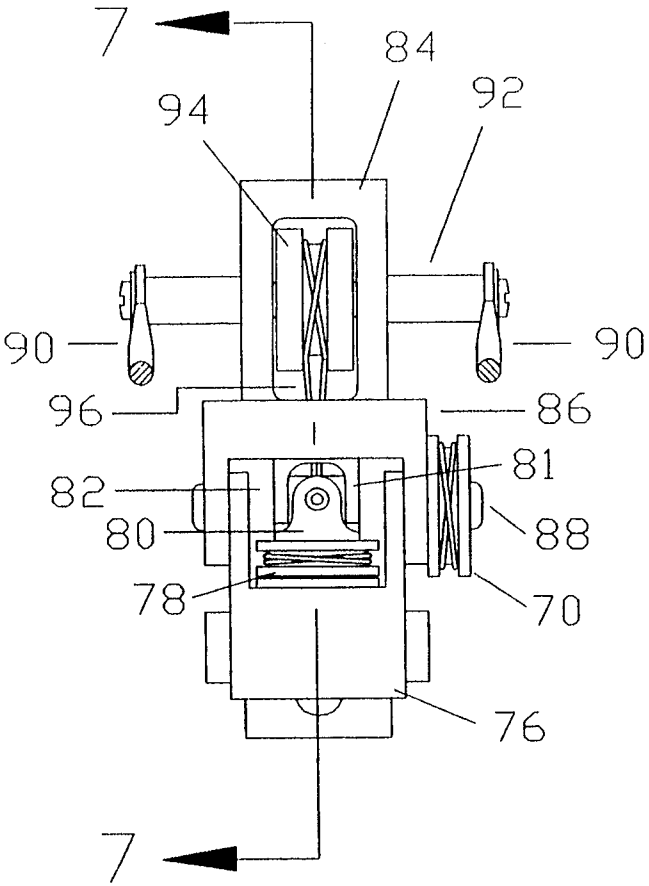
FIG. 6 is an enlarged front view of the golfer's internal mechanism shown in FIG. 4 with the arms cut away to expose the universal joint assembly.

FIGS. 4–5 illustrate the motions animating golfer 64. The waist-bending motion will be described in full as it represents the driving method for all local motions of golfer 64. A small stepping motor 65 is mounted to lower plate 58. A spindle 68 is attached to the shaft of stepping motor 65. A single waist-bend pulley 70 is mounted inside golfer 64. A loop of a flexible cable 72 runs between spindle 68 and pulley 70. Two strands of cable 72 are fed from spindle 68 to plate 58 through hole 42, down, inside, and around the 90-degree bend in support tube 60, and the two strands wrap several times around pulley 70. Cable 72 is wound in opposite directions on each side of spindle 68 so that rotation of motor 65 causes one strand of cable to be taken up at spindle 68 while the other strand of cable is let out. This cable movement translates to a corresponding coordinated motion in golfer 64's waist-bend pulley 70.

Cable 72 is made of 0.024" 7×7 stainless steel to minimize stretch and maximize flexibility. Each strand is run through a Teflon tube to lubricate, to smooth sharp bends, and to isolate the strands from each other and from the walls of support tube 60. The shaft diameter of spindle 68 is ⅛" while the diameter of pulley 70 is ½". The 4 to 1 mechanical advantage thus provided to the motor increases output torque and positioning resolution.

There are many advantages to this method of power transmission, especially in this type of application. First, the system requires no static tension, as it would if it were a single cable system. In the latter case, pulley 70 would require a return spring. The present method minimizes binding, lowers the torque required from motor 65, and reduces distorting forces on support tube 60.

Second, large-reduction drive ratios are easily implemented. (The drive ratio is the ratio of pulley 70's diameter to spindle 68's shaft diameter.) Large ratios are desirable both to keep motor size (and therefore cost) low and to provide good positioning resolution.

Third, lack of static tension and its inherent binding allows the cables to be routed through many bends. This simplifies mounting of the overhead motors (they need not be directly over hole 42) and allows elaborate branching within golfer 64 to control many functions with only drill holes as guides.

Fourth, the cable sees only tension loads, so it can be very thin. Thus it can be guided through sharp bends, in contrast to a single push-pull cable that must be made stiff to prevent buckling under compression loads.

Fifth, in contrast to remote drive via flexible shafting, there is almost no backlash.

Sixth, axes can be easily made to rotate much greater than 360 degrees by wrapping multiple turns of cable 72 around pulley 70 and spindle 68.

Seventh, no special mechanics are required inside golfer 64. A single pulley for each axis of motion is enough, thereby allowing more functions to be fitted into a small figure.

Referring to FIGS. 4, 5, 6, and 7, golfer 64 comprises a base block 76 rigidly fixed to support tube 60. A waist-twist pulley 78 is set into base block 76 and is free to rotate about a spindle 69. Pulley 78 is driven by a stepping motor 66 and a flexible cable 71 in the same manner as described above for waist-bend pulley 70. A lower half 80 of a universal joint 81 is fixed to the top of pulley 78. Golfer 64's torso 84 is fixed to an upper half 82 of universal joint 81. A bracket 86 encircles torso 84, positioning torso 84 and allowing it freedom to rotate. Bracket 86 is fixed to base block 76 by a hinge 88. The axis of hinge 88 is centered on the hinging center of universal joint 81. Pulley 70 is fixed to bracket 86. Rotation of pulley 70 causes bracket 86 to move along with the upper half of the universal joint 82 and thereby move torso 84 to make golfer 64 bend at the waist. Rotation of pulley 78 causes universal joint 81 to rotate along with torso 84, thereby twisting golfer 64's body.

It can be seen that the twisting and bending movements are completely independent. Making one has no effect on the other. Also, both waist-twist pulley 78 and waist-bend pulley 70 move only in rotation; neither moves in translation. Thus each pulley 70, 78 maintains a fixed distance from its spindle 68, 69, thereby maintaining constant tension on its associated cable 72, 71.

A pair of arms 90 is fastened to a common shaft 92. A pulley 94 is fixed to shaft 92 at its center. A two-stranded drive cable 96 for pulley 94 is routed through a hole 95 drilled through the center of universal joint 81's spider. A stepping motor 67 drives cable 96 to permit golfer 64 to move arms 90 and thus swing club 74. As golfer 64 is bent or twisted at the waist there is minimal stretch induced in cable 96. Thus the cable length from pulley 94 to the arm motor spindle remains almost constant, and positioning of arms 90 is not affected by, or has no effect on, either motion of the waist whether twist or bend.

Referring again to FIGS. 1 and 1(A), golfer 64's walking is effected by operating motors 18 and 28, thereby moving support tube 60 and attached golfer 64 about the course surface in the x-y plane. To add realism, simultaneous operation of motor 54 rotates golfer 64 about axis of rotation 62 to face in the direction of x-y movement. Further realism is achieved by operating a z-axis stepping motor (not shown) to move golfer 64 vertically along the z-axis to follow the sloping faces of hills and valleys, that is, golfer 64 follows the terrain.

To make golfer 64 follow the sloping terrain while walking requires an electronic motor controller 308 that operates four motors simultaneously and independently and that has on-the-fly position readback capability. The step position of each motor relates to a physical location on the axis it controls. Motor controller 304 must have a communication path to accept and execute commands from the host computer in no more than about 1/20 second (50 msec). The present embodiment utilizes a commercially-available controller that meets these minimum requirements.

The surface height of course 8 is digitized every 1/10", creating a data array of 360×360=129,600 height values. This array will be referred to as the z-map. The position of a data element in the array corresponds to a position on course 8. The value of the data element is the height of course 8 within a 1/10" square area. Thus every square inch of the terrain is characterized by 100 numeric values representing relative height or distance along the z-axis. The z-map array is created initially by temporarily replacing the figure of golfer 64 with a push-button switch assembly (not shown). The push-button is activated by a 2" long, 1/10" diameter solid rod and spring aimed downwards towards the surface of course 8. An electronic interface allows the computer to read the state of the switch. Moving the switch assembly downwards by activating the z-axis motor causes the rod to contact the surface, then compress the spring, and finally close the switch. To map the surface, the switch assembly is raised to maximum height to clear all terrain protrusions, then the motors 18 and 28 are used to move the switch assembly to a corner of the course arbitrarily assigned (x, y) location (1, 1). The switch is then lowered at a slow rate while the computer polls the state of the switch. As soon as the computer detects a switch closure, the z-axis motor is commanded to stop. The position (in motor steps) of the z-axis motor is recorded as the surface height at this (x, y) location on course 8. This procedure is repeated for every 1/10" (x, y) location on the course. The entire mapping presently takes about 72 hours but is only performed once for any given surface of course 8. The mapping array is stored as a disk file when the mapping operation finishes.

The terrain height data is normally stored as positive numbers, with 1 representing the lowest point on the surface and the rising faces of hills represented by increasingly positive values. To represent areas that are physically off limits to golfer 64, the sign of the values in the data array corresponding to the x-y coordinates of these areas are made negative, with the magnitudes unchanged. It will be shown that this method of representation permits computer 310 to prevent golfer 64 walking into these off-limits areas but still allows playing a ball that has rolled into an off-limits area as long as the ball is within arm's reach of golfer 64 standing at the edge of an off-limits area.

In the present embodiment, the array locations representing the outer 3" at the golf course perimeters are set to negative. This information is recognized by computer 310 when the golfer is near the edge of the course, as described below. It will be shown that this technique prevents golfer 64's body center from moving closer than 3" to any perimeter wall. Thus golfer 64 avoids any contact with clear plastic panels 4. However, golfer 64's arms 90 and club 74 can still reach into this 3" band of golf course and address a ball that has landed there.

A software utility allows any arbitrary rectangular area on course 8 to have its array values set to negative. For example, it is desired to add a stand of trees near the center of course 8. The software utility allows the player to position golfer 64, via a control panel joystick 306, at one corner of the stand of trees. Then the player is prompted to use joystick 306 to move golfer 64 to the diagonally opposite corner of course 8. The entire rectangular area thus defined has its array values set negative. The data array can then be re-saved on disk to permanently record this change. Thereafter, an attempt by a player to "walk" golfer 64 through the rectangular area thus defined will be prevented by computer 310.

Referring to FIG. 2, when the game is started, golfer 64 appears standing erect facing forward with arms 90 and club 74 pointed downwards. No motors are operating, so golfer 64 is motionless.

Figure 8A:
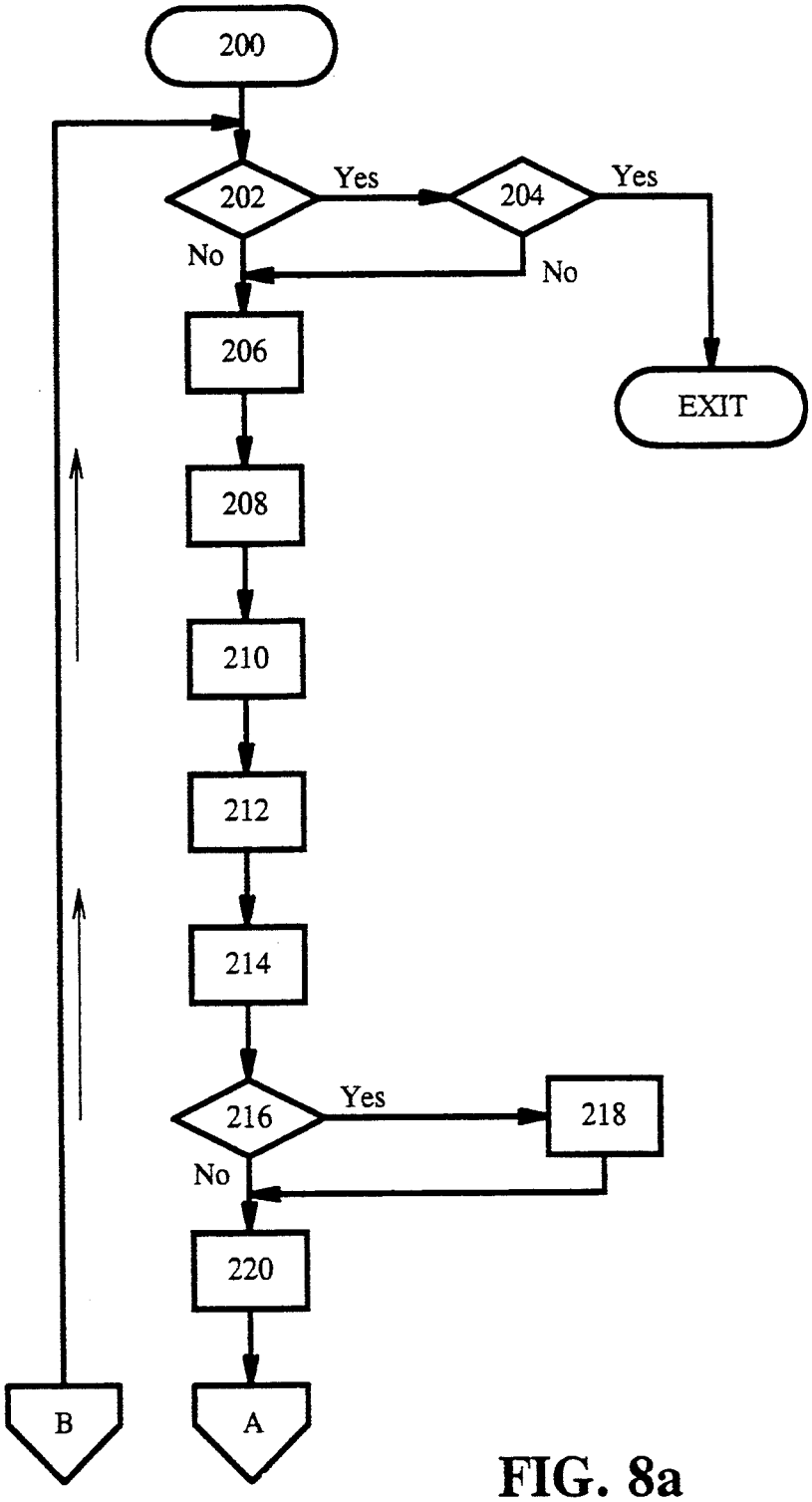
FIGS. 8*a* and 8*b* is a flowchart showing the steps taken by the human player and the computer in manual-play mode.

FIG. 8*a* shows the sequence of steps in manual-play mode. Computer 310 executes this sequence of steps continually. To achieve smooth, realistic operation, the entire program must execute at least ten times each second. Program execution speed is a function of the computational speed of computer 310, the time required to perform and acquire A/D readings from the potentiometers of joystick 306 (see FIG. 11) in step 206, and the time required to issue a command to a motor controller 308 (see FIG. 11) and have it complete the sequence of commands from step 202 to step 220. In the present embodiment, the program executes about 30 times each second.

The main control program 200 is repeated continuously, allowing a player to walk golfer 64 about course 8 to be positioned for the next shot. On the first pass through program 200, a decision in step 202 will always be "Yes". When golfer 64 is moving about course 8 prior to taking a swing, the decision in step 204 will be "No". Assuming the ball is resting some distance from golfer 64, the player now indicates, by deflecting joystick 306, the x-y direction and speed he wishes golfer 64 to walk at to address the ball. Golfer 64 will not actually begin moving until step 220. Prior to beginning movement, steps 208–216 and, optionally, step 218 are performed to determine if the walking request coming from the player via joystick 306 can be honored.

Golfer 64's x, y, z reference position is arbitrarily chosen to be a point on the soles of his shoes, on his vertical centerline when he stands erect. Thus if, at a given x-y location on the course, for example: (x=50, y=75), the z-axis data array has a value of +100 units, positioning the golfer at (x=50, y=75, z=101) will locate the center of the golfer's shoes just above the surface at that point on the course. Motor controller 308 maintains registers with the number of steps that have been issued to each motor. Stepping motors 54, 65, 66, and the z-axis motor drive all motions synchronously by either timing belt, direct gear mesh, lead screw, or non-slipping cable. The number of steps issued to a motor therefore represents a specific position on the axis it controls. The computer may query motor controller 308 for motor step positions and calculate from them what linear or angular position is represented. This calculation is carried out at step 208.

At step 210 it is initially assumed that golfer 64 will walk in the direction and at the speed requested from joystick 306, when it is deflected fully, by commanding motors 18 and 28 to operate at their predetermined maximum rates. At step 212 joystick 306's x-y deflection is translated into percentages of maximum deflection. This calculation yields a vector representing the player's requested walking direction and speed. At step 214 the x-y location of golfer 64 is related to its corresponding position in the z-map data array. A line-drawing algorithm computes a projected line on the x-y plane of the course in the direction golfer 64 is walking. The projected line starts at golfer 64's present x-y position. The z-map array for each x-y data point on this line is checked for a negative value for 30 points (or data locations) along the line. (As noted above, these points are spaced 1/10" apart.) If a negative value is found, its position among points 1 to 30 is noted at step 216. At step 218, this relative position is divided by the full 30 points to yield a percentage. The maximum walking rates initialized in step 210 are reduced by this percentage. The percentage calculation is carried out so that, if the first point on the projected line in 214 is found from the z-map to be negative, the percentage is zero.

At step 220 computer 310 calculates the stepping rates required to operate motors 18 and 28 to mirror the deflections of joystick 306. If step 218 has produced maximum limits that are smaller than these rates, the limit value is substituted. This substitution prevents the player from causing golfer 64 to walk into a panel 4. If the player pushes joystick 306 to its full deflection and holds it there, computer 310 commands golfer 64 to walk at full speed towards a panel 4. At two inches from panel 4, computer 310 commands only 2/3 speed; at one inch from the wall, 1/3 speed. And so on until finally, upon reaching the wall, computer 310 commands 0 speed, which means that golfer 64 is stopped. In the present embodiment the z-map data array values in all the locations within three inches of the borders are preset to negative values. This will always maintain three inches between the center of golfer 64 and panels 4 to allow room for turning and swinging.

Figure 8B:
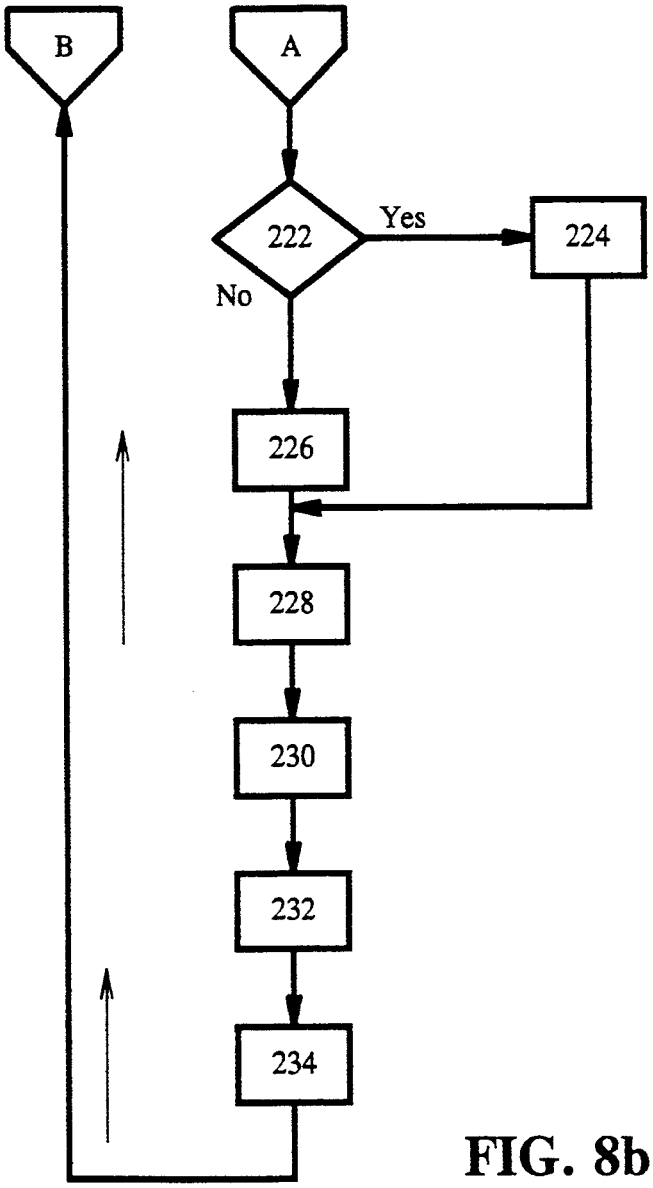
Figure 9A:
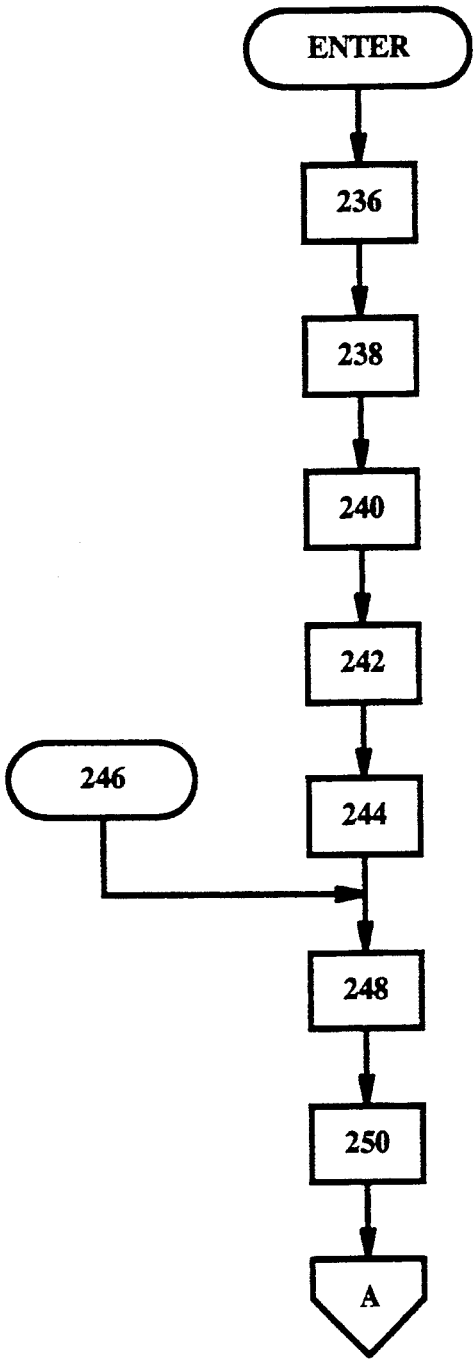
FIGS. 9*a* and 9*b* is a flowchart showing in more detail the actions taken by the human player and computer to effect the golf swing portion of the manual play mode flowcharted in FIG. 8.
Figure 9B:
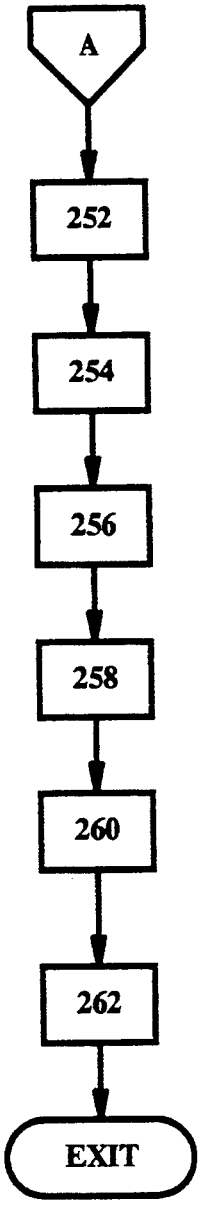

Referring to FIG. 8*b*, golfer 64's rotational movement is determined at steps 222, 224, and 226. For normal walking rates, step 222 yields a No, leading to step 226. By comparing golfer 64's present Theta-axis angular position to the walking vector angular direction from joystick 306, a decision is made whether the player intends golfer 64 to walk forwards or backwards. If the walking vector angle is between +90 and −90 degrees of golfer 64's present angle, forward walking is assumed. Motor 54 is commanded to a step position corresponding to the walking vector direction, thus facing golfer 64 in the direction of walking. At all other angles, motor 54 is commanded to produce an angle 180 degrees from the walking vector angle, thus turning golfer 64's back to the direction of walking.

In step 224 the player can fine tune golfer 64's position when setting up to address the ball. If joystick 306 is twisted when it has been pushed more than ¼ of its full deflection, the twisting is ignored. However, a slight twisting, either right or left, of joystick 306 without deflection causes golfer 64 to turn on his heels. Golfer 64 can also be side stepped, without being turned around, by a slight deflection without twisting of joystick 306. Step 224 also allows golfer 64's Theta-axis angle to be adjusted independently without any walking, since step 226 requires some walking movement to be present to determine the Theta-axis angle.

Automatic terrain following is performed at steps 228, 230, 232, and 234. Step 230, though similar to step 214, is performed for a single z-map data point. It yields the actual magnitude of the z-map data rather than a simple positive/negative flag as in step 214. At step 232 the height is calculated to which golfer 64 must be raised to keep any part of his shoes from contacting any terrain feature. Golfer 64's footprints cover a fixed area larger than 1/10" square. In the present embodiment this area is 0.8" long, 0.6" wide or an area of 48 1/10" squares. Golfer 64's x-y-z position is a point at the center of this footprint. All z-map data values lying under this footprint are checked for terrain height.

Determining which points these are is complicated by the present Theta-axis rotational angle, which causes the footprint to shadow different areas. Because of the speed requirement for execution of program 200, determining all points by trigonometric calculation would necessitate a faster, more costly computer. As a compromise, the footprint shadow on the x-y plane is precalculated for every 10 degrees of rotation and stored in a series of tables. The data in these tables are x-y offsets from a given point in the z-map data array. In step 232, the present Theta-axis position is read back from motor controller 308 and rounded to the nearest 10 degrees. The Z-map is selectively scanned for the highest height value from a table corresponding to this 10 degree rotational increment. This highest value becomes the result from step 232. Step 234 uses the results of steps 230 and 232.

Referring to FIG. 11, the program 200 continues indefinitely until the decision in step 204 is "Yes" when the player presses a button 298.

Referring to FIGS. 9*a*, 9*b*, 10*a*, 10*b*, and 11, putting the apparatus into the swing mode alters the functionality of joystick 306. Prior to entering the swing mode, the player has been using joystick 306 to position golfer 64 to address the ball. The player now indicates that golfer 64 will swing by pressing button 298. Computer 310 responds by illuminating a lamp 300, thereby informing the player that joystick 310 no longer controls walking. The player now looks at golfer 64 and pushes joystick 306 in the direction he wishes the ball to be hit. The amount of deflection determines the relative force of the swing. Holding joystick 306 deflected, the player presses button 302.

At step 238 computer 310 is waiting for button 302 to be pressed. As soon as button 302 is pressed, the deflection of joystick 306 is read in at step 240. Computer 310 then indicates at step 242, by extinguishing lamp 300, that the player let go of joystick 306. At step 244 computer 310 compares the present Theta-axis angular position of golfer 64 to the angle of joystick 306's deflection read in at step 240 and determines whether the swing is to be left-handed or fight-handed.

Steps 248, 250, 252, and 254 are required to realistically negotiate a non-flat surface of course 8 during swinging. Compared to golfer 64's shoes, the ball may be on a hill or in a valley, necessitating adjustment of golfer 64's arm/club angle to align the head of club 74 with the surface. Step 248 moves the club head high enough to clear any possible terrain feature before golfer 64's waist is bent forward. Steps 250, 252, and 254 are calculations only; they appear to the player as a brief pause. At step 250 golfer 64's waist bend angle is rotated forward 30 degrees, then the arm/club angle is rotated downwards in one degree increments. At each degree increment, the z-map data array elements lying directly under the club head shadow are checked for height. Calculation of the shadow x-y plane coordinates includes golfer 64's Theta-axis angular position and the distance of the club head from golfer 64. Both the club head height and the distance from golfer 64 vary as the club head is rotated downwards. At some point the terrain height under the club head shadow will be greater than the club head height. The arm/club angle prior to this event is the result from step 250. The arc of swing must now be checked in step 254 to see if it will cause the club head to contact the terrain, as, for example, if golfer 64 is standing near a hill. Step 252 initializes the swing to be unrestricted. Step 254 uses the arm angle resulting from step 250 and the inherent 30-degree forward bend angle to twist golfer 64's waist in one degree increments. Again, the club head shadow is calculated from golfer 64's Theta-axis angle, the waist twist angle, and the z-map data consulted. The club height increases with increasing waist twist angle. At the first angle, if any, where the club has a height value less than the z-map data point, the previous angle is assigned to the limits set in step 252.

Steps 256, 258, and 260 perform the actual swing. Simultaneous motion of stepping motors 65, 66, and 67 gives a realistic, non-robotic appearance. Step 262 returns golfer 64 to the rest position as in FIG. 2.

Figure 10A:
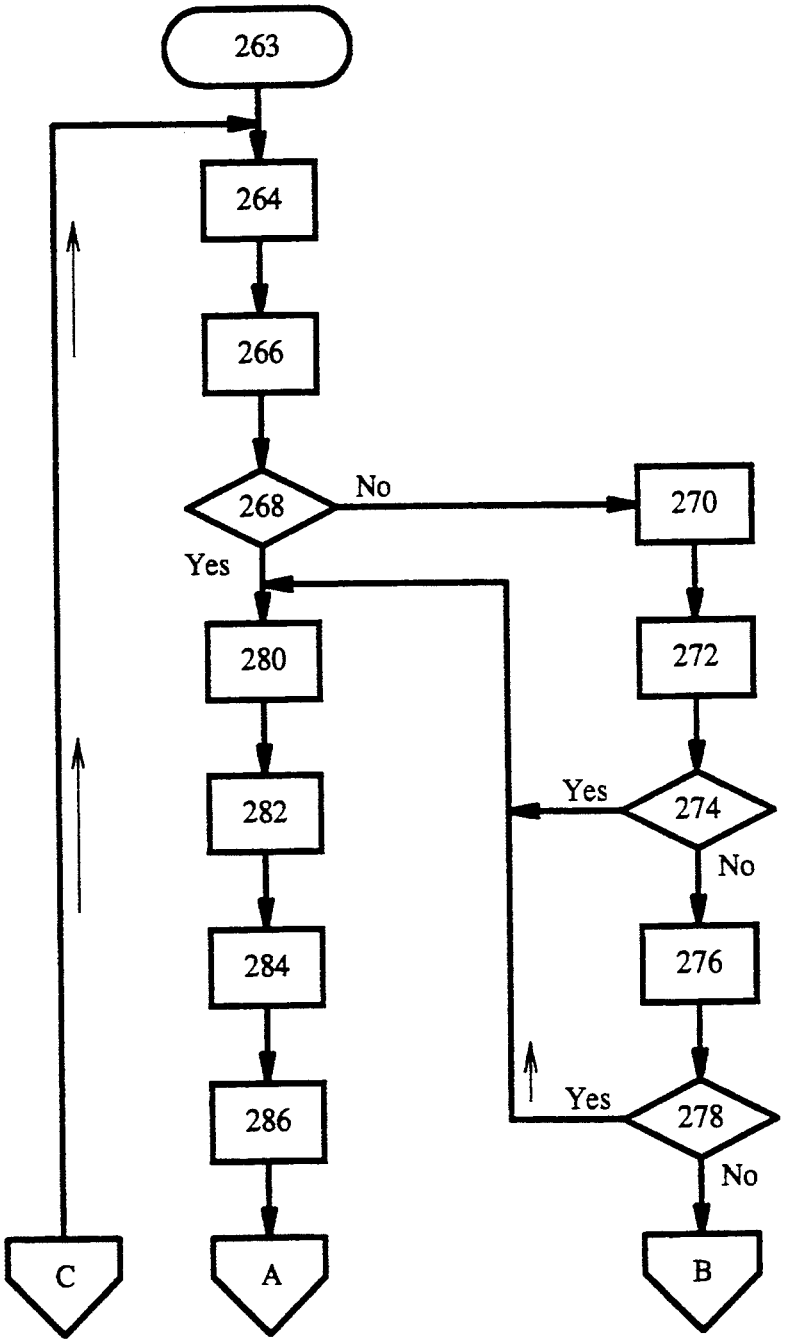
FIGS. 10*a* and 10*b* is a flowchart showing the steps taken by the computer in automatic-play mode.
Figure 10B:
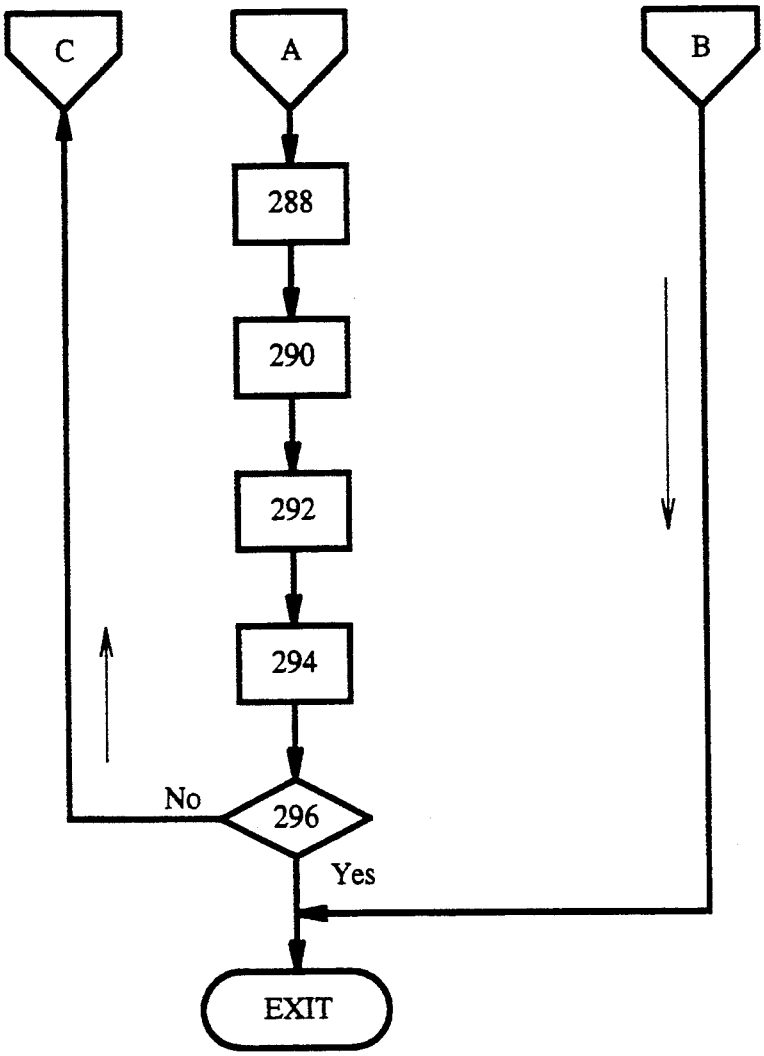

Referring to FIGS. 10*a* and 10*b*, in auto play mode a program 263 executes with no intervention by the player. In steps 264 and 266 computer 310 attempts to locate the ball on course 8 with video camera 98. Video frame grabber 304 supplies the camera image as an array of gray scale values. The ball's image size and brightness have been previously characterized during assembly of the apparatus. The ball is fashioned of white plastic. All areas on the surface are made to appear darker than the ball when viewed in the video image. For the grass areas, a green color accomplishes this. Sand traps are tinted dark enough to allow sufficient contrast with the ball. The surface of course 8 is lit from all angles (not shown) to help eliminate shadows that tend to hide the ball against a sand trap. The ball appears as the brightest gray scale level in the camera image array. At step 268, if the ball is not found in the video image, it is first assumed to be eclipsed by the body of golfer 64, which is always present in the image. In step 270 computer 310 walks golfer 64 a predetermined few inches away, an offset sufficient to allow the video image to expose the portions of course 8 previously eclipsed. At step 272 a new video image is acquired and searched for the ball. If the ball is still not found (step 274), it is assumed to be somewhere on course 8 but out of the present field of view of camera 98. Computer 310 moves golfer 64 (and thus camera 98) to different sections of the course trying to move camera 98's field of view over the ball. Eventually, the ball should be found. An error condition exists if the ball cannot be found, and auto play mode must be terminated. Manual mode is still operational.

Normally the ball will be found in the video image. Step 280 relates the ball's position in the video image to an x-y location on course 8. (The mapping of video coordinates to course coordinates is characterized during assembly of the apparatus.) Steps 282 and 284 are calculations only; they produce no motion of golfer 64. Steps 286 and 288 move golfer 64 into position. The steps shown in FIGS. 8*a* and 8*b* are executed, except that inputs from joystick 306 are replaced with walking vector magnitude and direction generated by computer 310. Step 290 performs the equivalent of step 240 and step 244 of FIG. 9*a*. Step 292 calls the procedure of FIGS. 9*a* and 9*b*, beginning execution at step 246. Steps 294 and 296 are optional; if the apparatus is intended as an animated decorative fixture they are unnecessary. Program 263 can repeat indefinitely. As each hole is made the next hole becomes the played hole (not shown).

Although not incorporated in the present embodiment, the elements of the apparatus are easily modified to allow auto play to assist the manual play of a physically or mentally impaired player. An example can be seen in step 204 of FIG. 8*a*. When the result is "Yes," computer 310 could completely take charge of the golf swing by locating the ball with the camera 98, adjusting precisely golfer 64's position, and calculating and executing an optimal swing. Control would then be returned to the player as before.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A model game, which comprises: a model playing area;

said model playing area including terrain with relief that models real terrain;

at least one model figure;

means for supporting said at least one model figure from overhead;

said means for supporting including means for remotely controlling a plurality of motions of said at least one figure;

said means for remotely controlling including a microcomputer;

said means for remotely controlling including means for modeling a plurality of motions of a real player playing a real game on a real playing area;

said means for modeling including means for positioning said at least one figure to appear to be on said model playing area; and said means for positioning effective for positioning said at least one model figure in three dimensions.

2. A model game as in claim 1, wherein said game is golf and said model playing area models a real golf course.

3. A model game as in claim 1, wherein said means for remotely controlling includes means for making said at least one figure follow irregular terrain on said model playing area.

4. A model game as in claim 1, wherein said means for supporting includes an overhead support.

5. A model game as in claim 1, wherein said means for modeling includes a video camera.

6. A model game as in claim 2, wherein said means for remotely controlling includes :means for making said at least one figure strike a ball in imitation of a real player's stroke.

7. A model game as in claim 1, wherein said means for remotely controlling includes means for intervention by a human player.

8. A model game as in claim 1, wherein said means for remotely controlling includes means for complete control by a human player.

9. A model game as in claim 1, wherein said means for remotely controlling is effective without intervention by a human player.

10. Apparatus for controlling a plurality of motions of a model sports-playing figure, which comprises:

said plurality of motions including a first class of motions of said figure as an entirety and a second class of motions of portions of said figure;

first means for controlling, said first means controlling motions of said first class on a two-dimensional plane;

second means for controlling, said second means controlling motions of said first class in a vertical dimension;

third means for controlling, said third means controlling motions of said first class in rotation about a vertical axis through said figure;

fourth means for controlling, said fourth means controlling motions of said second class;

means for supporting said figure, said means for supporting being located overhead said figure; and said means for supporting further comprising support for said first, second, third, and fourth means for controlling.

11. Apparatus as in claim 10, wherein each of said first, second, third, and fourth means for controlling includes a stepping motor.

12. Apparatus as in claim 10, wherein said second means for controlling automatically places said figure immediately above a particular point on a surface of varying height.

13. Apparatus as in claim 10, wherein said fourth means for controlling includes means for making said figure bend at the waist.

14. Apparatus as in claim 10, wherein said fourth means for controlling includes means for making said figure twist its torso relative to its legs.

15. Apparatus as in claim 10, wherein said fourth means for controlling includes means for making said figure move its arms up and down.

16. Apparatus for making a model figure stroke a ball to a cup, which comprises:

means for locating said ball on a playing surface;

said means for locating including a video camera and a microcomputer;

means for positioning said model figure adjacent said ball;

said means for positioning including said microcomputer;

means for determining, cooperating with said means for locating and said means for positioning, for calculating a force and a direction of a stroke;

said means for determining including said microcomputer; and means for making said model figure make said stroke with said force in said direction, whereby said ball moves proximately to said cup.

17. Apparatus as in claim 16, wherein:

said means for locating defines a map of a variable surface in x and y coordinates;

said means for determining defines a pair of a first and a second location in said x and y coordinates;

said first location is defined as the location of said model figure and said second location is defined as the location of said ball; and said means for determining is effective for storing said force and said direction for each of said pairs of locations, whereby said means for making is effective for causing said model figure to stroke said ball from said second location proximately to said cup.

18. A method of causing a model figure to stroke a ball to a cup, which comprises:

measuring a location of said ball on a playing surface in x, y, and z coordinates with a video camera;

positioning said model figure in locational x, y, z coordinates;

positioning said model figure in an angular coordinate that measures rotation of said figure from an axis;

determining a magnitude for said stroke; and operating said model figure to make said stroke.

19. Apparatus for positioning a model figure, which comprises:

means for measuring a location of said model figure on a surface in x and y coordinates;

said means for measuring including a video camera;

means for associating a z coordinate with each location of said model figure defined by said x and y coordinates;

said means for associating including a microcomputer;

means for positioning said model figure in said z direction according to said x and y coordinates when said location is occupied by said model figure; and said means for positioning including a plurality of stepping motors.

20. Apparatus for positioning a model figure as in claim 19, wherein said means for positioning includes at least one double-stranded sheathed cable, whereby at least one motion of said model figure is controlled by a cable subject only to tension forces.

* * * * *